US009758359B2

(12) United States Patent
Kamphuis et al.

(10) Patent No.: US 9,758,359 B2
(45) Date of Patent: Sep. 12, 2017

(54) JACK SYSTEM

(71) Applicant: K-Line Industries, Inc., Holland, MI (US)

(72) Inventors: Dwain L. Kamphuis, West Olive, MI (US); Lukas T. Woltjer, Zeeland, MI (US)

(73) Assignee: K-LINE INDUSTRIES, INC., Holland, MI (US)

( * ) Notice: Subject to any disclaimer, the term of this patent is extended or adjusted under 35 U.S.C. 154(b) by 0 days.

(21) Appl. No.: 14/997,676

(22) Filed: Jan. 18, 2016

(65) Prior Publication Data

US 2016/0280518 A1 Sep. 29, 2016

Related U.S. Application Data

(60) Provisional application No. 62/137,929, filed on Mar. 25, 2015.

(51) Int. Cl.
*B66F 3/08* (2006.01)
*B66F 3/46* (2006.01)

(52) U.S. Cl.
CPC . *B66F 3/08* (2013.01); *B66F 3/46* (2013.01)

(58) Field of Classification Search
CPC ..... B60S 9/06; B66F 3/08; B66F 3/16; B66F 3/18; B66F 3/36; B66F 3/44; B66F 3/46; B66F 7/025; B66F 7/10–7/14; Y10T 74/1864; Y10T 74/18648; Y10T 74/18656
USPC ..... 254/100, 103, 425, 7 B, 7 C, 7 R, 89 R, 254/92, 98, DIG. 2, DIG. 4, DIG. 8, 254/DIG. 16
See application file for complete search history.

(56) References Cited

U.S. PATENT DOCUMENTS 117,840 A * 8/1871 Weide ..... B66B 9/025 187/267
1,176,751 A * 3/1916 Hardy et al. ..... B66F 7/14 254/100

(Continued)

FOREIGN PATENT DOCUMENTS

AU WO 2009026649 A1 * 3/2009 ..... B66F 7/14
FR 2857000 1/2005

(Continued)

OTHER PUBLICATIONS

International Search Report and Written Opinion dated Mar. 30, 2012 (International Application No. PCT/US2011/065994).

(Continued)

*Primary Examiner* — Joseph J Hail
*Assistant Examiner* — Tyrone V Hall, Jr.
(74) *Attorney, Agent, or Firm* — Price Heneveld LLP

(57) ABSTRACT

The present jack apparatus is particularly adapted for heavy duty lifting. The jack apparatus includes a base; a pair of screw jacks; a yoke supported by the screw jacks; a lifting tube supported on the yoke; a shaft coupler coupling the screw jacks; a power unit driving one of the screw jacks and through the shaft coupler also driving the other screw jack; and a housing covering the screw jacks and other components. The pair of screw jacks each have threaded lifting shafts designed to eliminate risk of unexpected lowering of the jack's lifting tube even if power is lost. A jack system is described including two or more of the jack apparatus controlled by a single control for simultaneous operation.

16 Claims, 10 Drawing Sheets

(56) References Cited

U.S. PATENT DOCUMENTS 1,294,153 A * 2/1919 Parrish et al. ..... B66F 9/06 187/233
1,500,859 A * 7/1924 Wright ..... B66F 3/18 254/100
1,566,223 A * 12/1925 Manor ..... B66F 7/14 187/268
1,773,712 A * 8/1930 Wiard ..... H02P 1/54 254/93 R
2,163,959 A 6/1939 Nilson
2,903,258 A * 9/1959 Jovanovich ..... B25H 1/0007 248/176.1
2,908,408 A * 10/1959 Reed, Jr. ..... B60P 1/4421 187/267
4,330,105 A * 5/1982 Gallagher ..... B66F 7/025 254/89 R
4,396,047 A * 8/1983 Balkus ..... B27L 7/00 144/193.1
5,176,391 A * 1/1993 Schneider ..... B60G 17/005 180/41
5,188,379 A * 2/1993 Krause ..... B60S 9/12 254/423
5,354,034 A * 10/1994 Simko ..... B66F 1/06 254/111
5,370,058 A 12/1994 David
5,484,134 A 1/1996 Francis
6,237,953 B1 5/2001 Farmer
6,623,035 B1 9/2003 Schneider
6,634,461 B1 10/2003 Baker
6,751,953 B2 6/2004 Mentink et al.
6,802,555 B2 10/2004 Yoder et al.
6,848,693 B2 * 2/2005 Schneider ..... B60S 9/12 280/6.153
6,992,359 B2 1/2006 Nguyen et al.
7,014,012 B2 3/2006 Baker
7,025,178 B2 4/2006 Wengelski et al.
7,147,210 B2 12/2006 Foege et al.
7,214,770 B2 5/2007 Berkenstam et al.
7,219,770 B2 * 5/2007 Baker ..... B66F 3/46 187/210
7,258,382 B2 8/2007 Kunz et al.
7,296,779 B2 11/2007 Bakshi et al.
7,296,784 B2 11/2007 Peter
7,322,628 B2 1/2008 Kunz
7,343,846 B2 3/2008 Stanford et al.
7,360,815 B2 4/2008 Kunz et al.
7,360,821 B2 4/2008 Kunz
7,407,211 B2 8/2008 Kunz
7,407,239 B2 8/2008 Kunz
7,408,596 B2 8/2008 Kunz
7,497,492 B2 3/2009 Gonzalez et al.
7,500,816 B2 3/2009 Berends et al.
7,544,902 B2 6/2009 Stanford
7,610,636 B2 11/2009 Holmes et al.
7,712,583 B2 5/2010 Matsumoto
7,740,109 B2 6/2010 Möller et al.
7,815,200 B2 10/2010 Bakshi
7,871,114 B2 1/2011 Schultz et al.
7,900,562 B2 * 3/2011 Esposti ..... B61K 5/04 104/32.1
8,171,678 B2 5/2012 Stanford et al.
8,246,095 B2 8/2012 Radle et al.
8,282,075 B2 10/2012 Chan
8,282,444 B2 10/2012 Place
8,286,309 B2 10/2012 Landry
8,434,741 B2 5/2013 Radle et al.
8,459,019 B2 6/2013 Hohensee
8,523,145 B2 9/2013 Lancione et al.
8,573,564 B2 11/2013 Rashall
8,657,694 B2 2/2014 Horwath et al.
8,668,038 B2 3/2014 Krobot et al.
8,756,885 B1 6/2014 Mathews et al.
8,807,532 B2 8/2014 Horwath et al.
2001/0004109 A1 6/2001 Belley et al.
2002/0100901 A1 8/2002 Topelberg et al.
2005/0140100 A1 6/2005 Peter
2005/0184546 A1 8/2005 Kunz et al.
2006/0113452 A1 6/2006 Bakshi et al.
2006/0113453 A1 6/2006 Bakshi et al.
2007/0271762 A1 11/2007 Hohensee
2008/0034631 A1 * 2/2008 Kim ..... G09F 7/20 40/607.04
2011/0062399 A1 * 3/2011 Kooima ..... B66F 3/46 254/92
2012/0132872 A1 * 5/2012 Herbold ..... F16B 5/0233 254/92
2013/0240807 A1 9/2013 Radle et al.
2013/0269511 A1 * 10/2013 Lemke ..... B66F 3/30 91/55
2014/0175822 A1 6/2014 Kreil

FOREIGN PATENT DOCUMENTS

JP 033896 1/1991
SU 389 A1 9/1924
SU 679515 A1 8/1979

OTHER PUBLICATIONS

International Search Report and Written Opinion of the International Searching Authority dated Mar. 24, 2016 (International Application No. PCT/US2016/024031) 7 pages.

* cited by examiner

JACK SYSTEM

CROSS-REFERENCE TO RELATED APPLICATION

This application claims benefit under 35 USC §119(e) of Provisional Application Ser. No. 62/137,929, filed Mar. 25, 2015, entitled JACK SYSTEM, the entire contents of which are incorporated herein by reference.

BACKGROUND

The present invention relates to a jack apparatus for heavy duty lifting, and more particularly relates to a jack incorporating a pair of screw jacks supporting a yoke in a manner providing high load lifting capabilities, low (and adjustable) initial starting point for lifting, safe lifting without need for separate jack stand or locking mechanism, close-to-obstruction lifting (e.g. where an obstruction is close to a desired lift point), adaptability to different energy-based drive units (such as hydraulic, electric and/or pneumatic), and modularity (for easy assembly or repair or maintenance of the jack apparatus). Also, the present invention relates to a jack system and method using a control to simultaneously operate several of the jack apparatus for simultaneous lifting at multiple points on equipment. The present system is particularly useful in heavy industry such as mining and construction, but is not believed to be limited to only those industries.

Jack systems for lifting heavy objects are often needed for heavy machinery and equipment, such as are used in mining, construction, farming, earth-moving, and industrial applications. Many times, the equipment must be lifted on site, including outdoors. Safety is a significant concern since the equipment can be massive, yet it is difficult to police safe use due to the locations where the jacks are used. Known jack systems suffer from several limitations, including the need for use of separate jack stands to ensure the equipment does not unexpectedly lower and injure a worker. Also, known jacks are limited in their ability to jack at different starting heights (e.g. very low ground clearance conditions) and to different ending heights (e.g. a combination of high initial ground clearance and high lift requirement to satisfy the maintenance need.) Additional characteristics are desired that are often not found in existing jack systems, such as modularity (so that components can be replaced easily in the field), ability to use different power sources to operate the jacks (e.g. electric, or hydraulic, or pneumatic power), portability (i.e. durable enough for heavy-duty use but sufficiently light and portable for movement over rough terrain), safety against unexpected lowering of the jack even when a jack stand is not used (i.e. so that there is less risk of a worker bypassing safety procedures), close-to obstruction lifting where the obstruction is only inches for a desired lift point (such as when a wheel is close to a frame lift point). Also, a jack system is desired that can be used in a system where several jacks are controlled simultaneously for simultaneous lifting of equipment at multiple points on the equipment.

SUMMARY OF THE PRESENT INVENTION

In one aspect of the present invention, a jack apparatus for heaving duty lifting comprises a base; a pair of screw jacks on the base; a yoke supported for lifting by the screw jacks; a lifting tube supported on the yoke; a shaft coupler mechanically operatively linking the screw jacks; a power unit driving the shaft coupler; and a housing covering at least the yoke and shaft coupler and a lower portion of the screw jacks.

In another aspect of the present invention, a jack apparatus for heavy duty lifting comprises a base; a pair of screw jacks on the base; a yoke supported for lifting by the screw jacks; a lifting tube supported on the yoke; a shaft coupler for simultaneously operating the screw jacks; and a power unit driving the shaft coupler.

In another aspect of the present invention, a jack apparatus for heavy duty lifting comprises a pair of screw jacks; a yoke having ends supported by the screw jacks and a lower center section; a lifting tube supported on the center section of the yoke; and a power unit for simultaneously driving the screw jacks to lift the yoke and lifting tube.

In another aspect of the present invention, a jack apparatus for heavy duty lifting comprises a base including a base plate, a cylindrical tube section, and angled braces supporting the tube section vertically on the base plate; a pair of screw jacks on the base; a yoke extending between and supported for lifting by the screw jacks; a lifting tube supported on the yoke and extending upwardly slidably through the tube section; a power unit operating the screw jacks simultaneously; and a housing covering at least the yoke and having slots receiving portions of the angled braces to avoid interferingly engaging one of the braces. The housing and base define a narrowest top that extends laterally less than 3.5 inches from a center of the lifting tube.

In another aspect of the present invention, a jack apparatus for heavy duty lifting comprises a base including a base plate, a cylindrical tube section, and angled braces supporting the tube section on the base plate; a pair of screw jacks on the base; a yoke extending between and supported for lifting by the screw jacks; and a plurality of lifting tubes having different lengths and adapted to be supported on the yoke with an upper end extending upwardly slidably through the tube section, each of the lifting tubes being releasably supported on the yoke for replacement so that the jack apparatus has different lowest and highest lift points.

In another aspect of the present invention, a jack apparatus for heavy duty lifting comprises at least two jack apparatus for simultaneous operation for heavy duty lifting; each jack apparatus including a pair of screw jacks with a threaded lifting shaft and a rotatable driving member for vertically extending the threaded lifting shaft, a yoke having ends supported by the lifting shafts of the screw jacks and a lower center section, a lifting tube supported on the center section of the yoke, and a power unit for simultaneously driving the screw jacks to lift the yoke and lifting tube; and a control unit operably connected to each of the power units of each jack apparatus to simultaneously operate each of the jack assemblies an equivalent amount.

In another aspect of the present invention, a jack apparatus for heavy duty lifting comprises a plurality of jacks, each including a base with at least one screw jack on the base; a lifting tube supported by the at least one screw jack; a shaft coupler for operating the at least one screw jack; and an electric drive unit coupled to and configured to drive the shaft coupler. The apparatus further includes a control system operably connected to the electric drive unit of each jack for operating each of the jacks individually or simultaneously, the control system including circuit breakers associated with each of the jacks, the control system being configured to shut down selected ones of jacks if the circuit breaker of a particular one of the jacks indicates a problem.

In another aspect of the present invention, a method for heavy duty lifting comprising providing a plurality of jacks, each including a base with at least one screw jack on the base; a lifting tube supported by the at least one screw jack; a shaft coupler for operating the at least one screw jack; and an electric drive unit coupled to and configured to drive the shaft coupler. The method further includes providing a control system operably connected to the electric drive unit of each jack for operating each of the jacks individually or simultaneously, the control system including circuit breakers associated with each of the jacks, and shutting down all of the jacks if the circuit breaker of one of the jacks indicates a problem.

These and other aspects, objects, and features of the present invention will be understood and appreciated by those skilled in the art upon studying the following specification, claims, and appended drawings.

DETAILED DESCRIPTION OF PREFERRED EMBODIMENT

Figure 1:
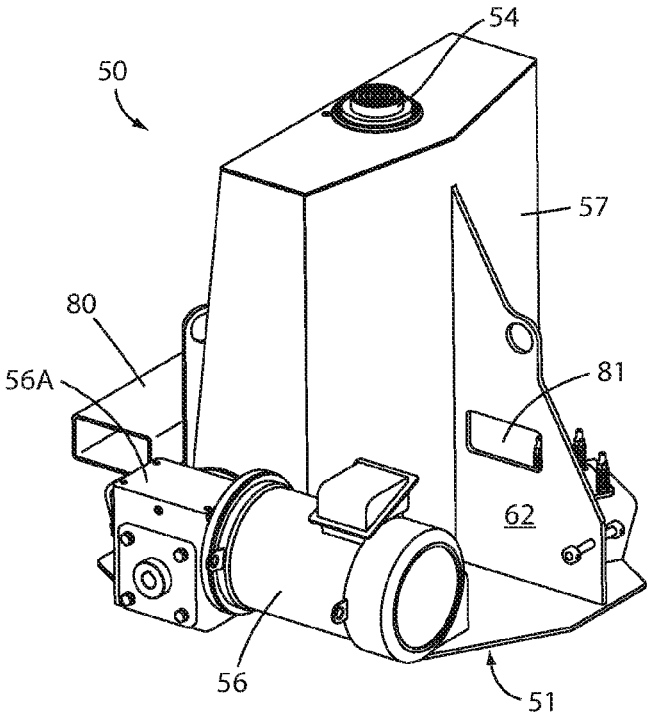
FIGS. 1-4 are perspective views of the present jack apparatus, FIGS. 1-2 showing a housing in place, and FIGS. 3-4 showing the housing exploded away to show underlying components.
Figure 2:
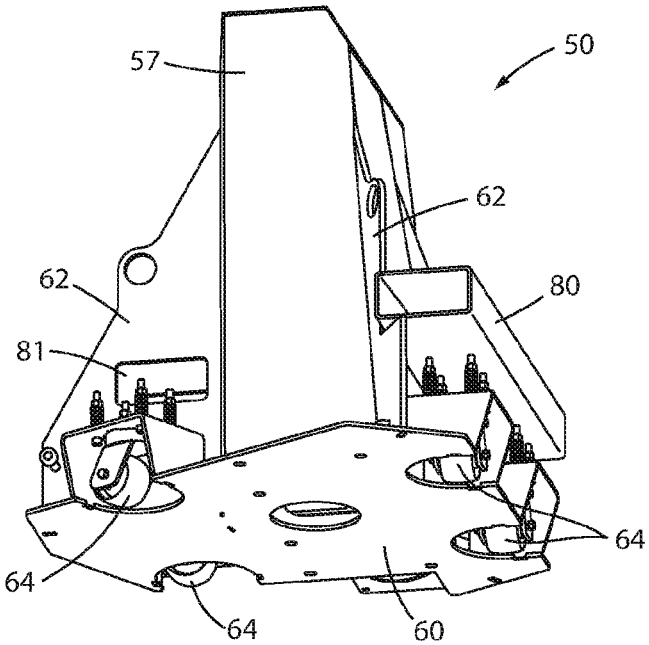
Figure 3:
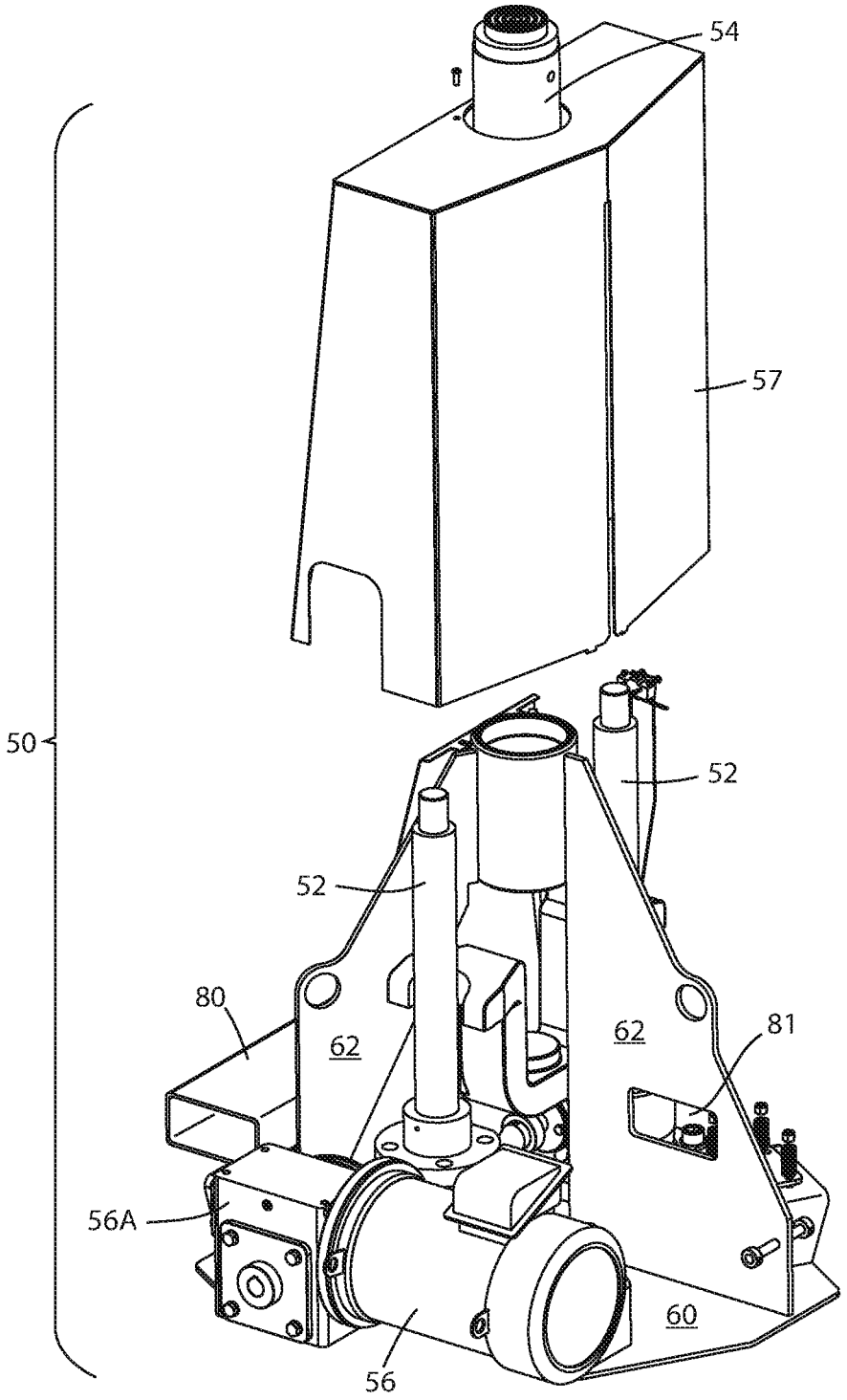
Figure 4:
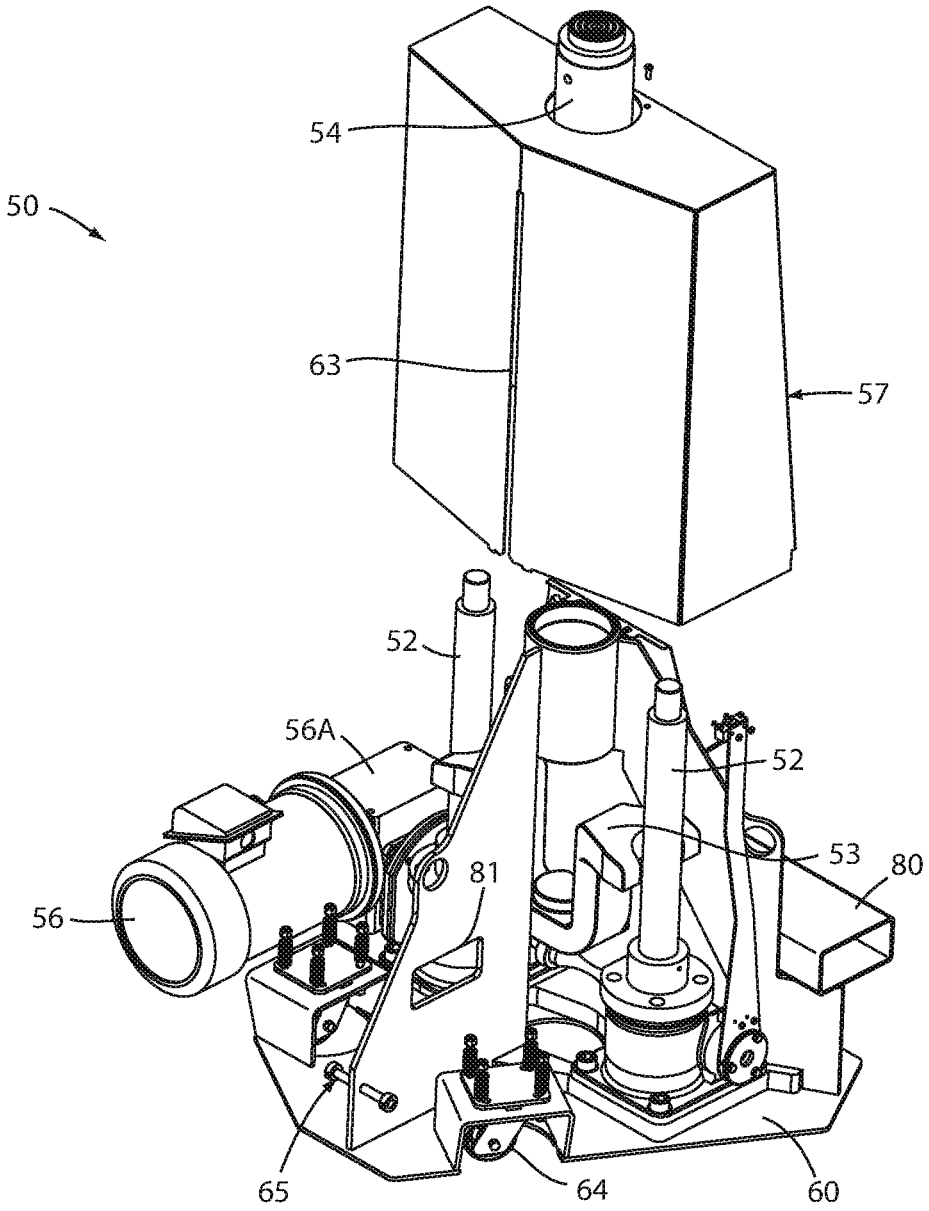
Figure 5:
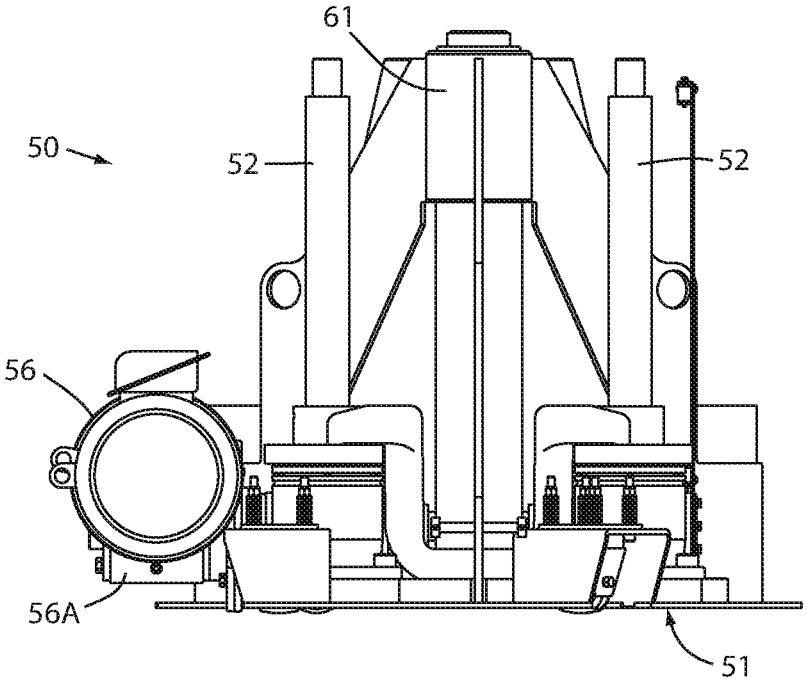
FIGS. 5-6 are side and top views of the present jack apparatus of FIG. 1.
Figure 6:
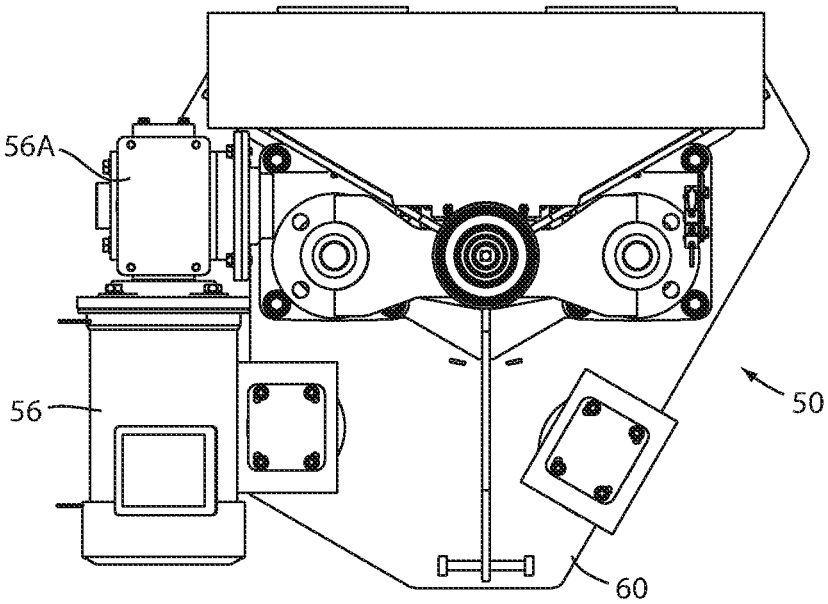
Figure 7:
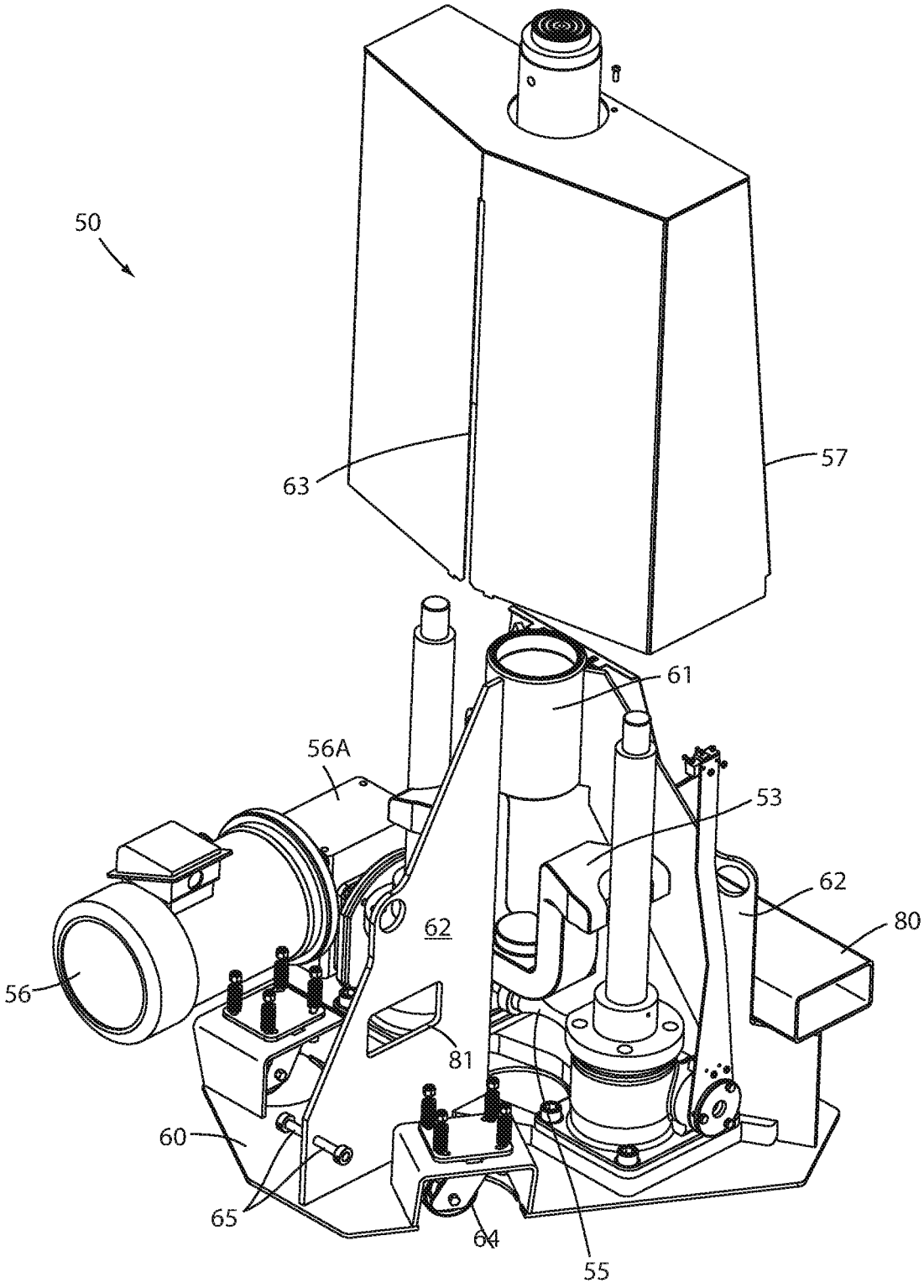
FIG. 7 is an enlarged view of FIG. 4.
Figure 8:
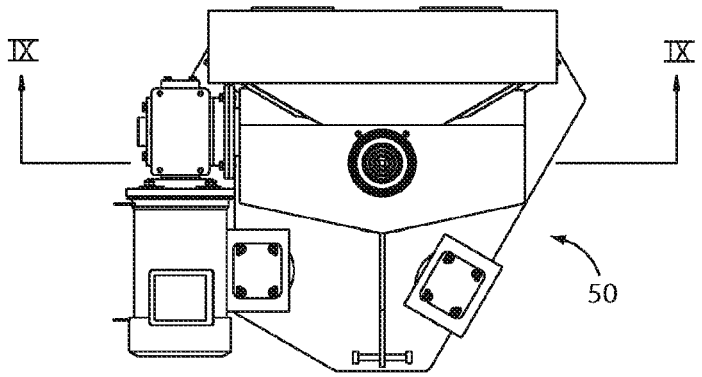
FIGS. 8-8B are top views like FIG. 6 but with cross section lines thereon.
Figure 8A:
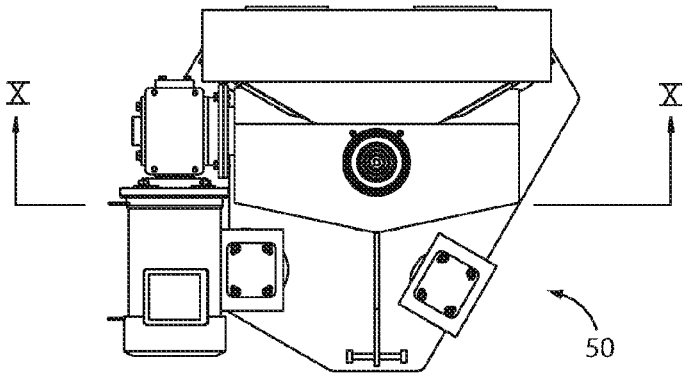
Figure 8B:
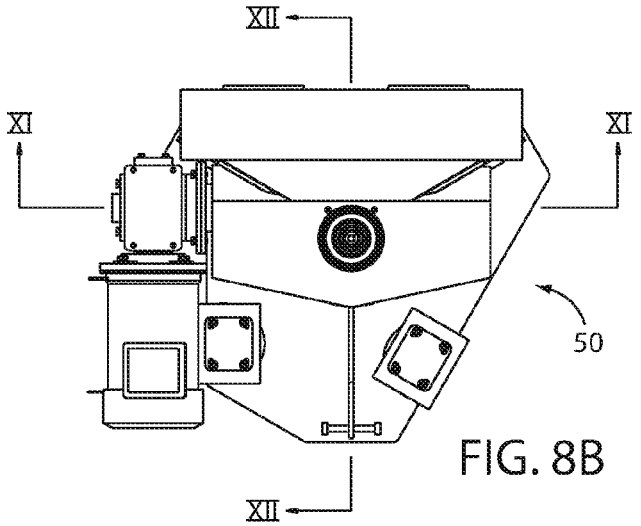
Figure 9:
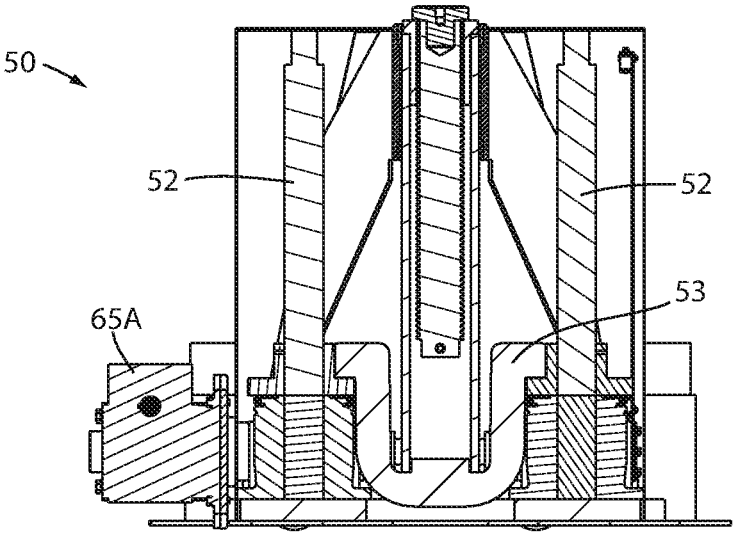
FIGS. 9-12 are cross sections taken along various lines in FIGS. 8-8B, with FIG. 11A being a schematic top view of the power unit and shaft coupler in FIG. 11.
Figure 10:
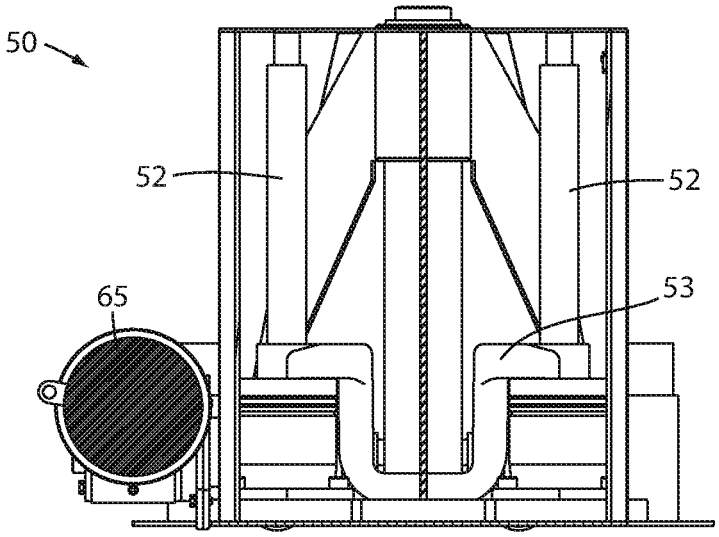

The present jack apparatus 50 (FIGS. 1-4) is particularly adapted for heavy-duty lifting, such as for lifting heavy machinery and equipment, such as are used in mining, construction, farming, earth-moving, and industrial applications. Many times, the equipment must be lifted on site and on uneven support, including outdoors. The present jack apparatus 50 is capable of jacking heavy loads, safely and without the need for jack stands.

The jack apparatus 50 includes a base 51; a pair of screw jacks 52 on the base 51; a yoke 53 with ends engaging the screw jacks 52 for lifting by the screw jacks 52; a lifting tube 54 supported on a lowered center portion of the yoke 53; a shaft coupler 55 for mechanically operative coupling the screw jacks 52; a combination power unit 56 and gearbox 56A (also called a "comdrive" herein, which are often sold as a unit) driving the shaft coupler 55; and a housing 57 covering at least the yoke 53 and shaft coupler 55 and a lower portion of the screw jacks 52. Jack screws are generally understood in the art and hence a detailed description of them is not required herein. Briefly, the pair of screw jacks 52 each have a rotatable driving member 52A (FIG. 11A) for rotating a threaded lifting shaft 52B to cause a lifting member (i.e. a nut) to walk up the threaded shaft and lift the yoke 53 and hence lift the lifting tube 54. The pitch of the threads are such that there is no risk of sudden or unexpected lowering of the jack's lifting tube 54, even if power is lost to the power unit 56. The shaft coupler 55 interconnects the drive unit 56 to the rotatable driving members of each of the screw jacks 52, such that each screw jack 52 necessarily extends at a same rate and distance to the other mated screw jack 52 on the other end of the yoke 53.

The base 51 includes a base plate 60 (illustrated as generally triangularly shaped, though it is contemplated that other shapes can be used), a cylindrical tube guide 61 for guiding extension of the lifting tube 54, and three angled braces 62 supporting the tube guide 61 above the base plate 60. The housing 57 includes sidewalls forming a downwardly concave shape, with some sidewalls including a slot 63 so that the housing 57 can non-interferingly slide downwardly over the braces 62 and downwardly against the base plate 60. The rear brace 62 can include a plate mating with a partially-open rear side of the housing 57 to form a closed cover for the jack apparatus 50. The removable housing 57 allows quick access to internal jack components for maintenance. Spring-biased castors 64 are supported on the base 51 to facilitate rolling movement. The castors' springs are designed to compress so that the jack is held in a stationary position when a load is applied. It is noted that four castors 64 are shown, but more or less can be provided. It is also contemplated that wheel brakes (spring loaded or otherwise) and/or other means can be used to prevent unintentional moving of the jacks.

Figure 15:
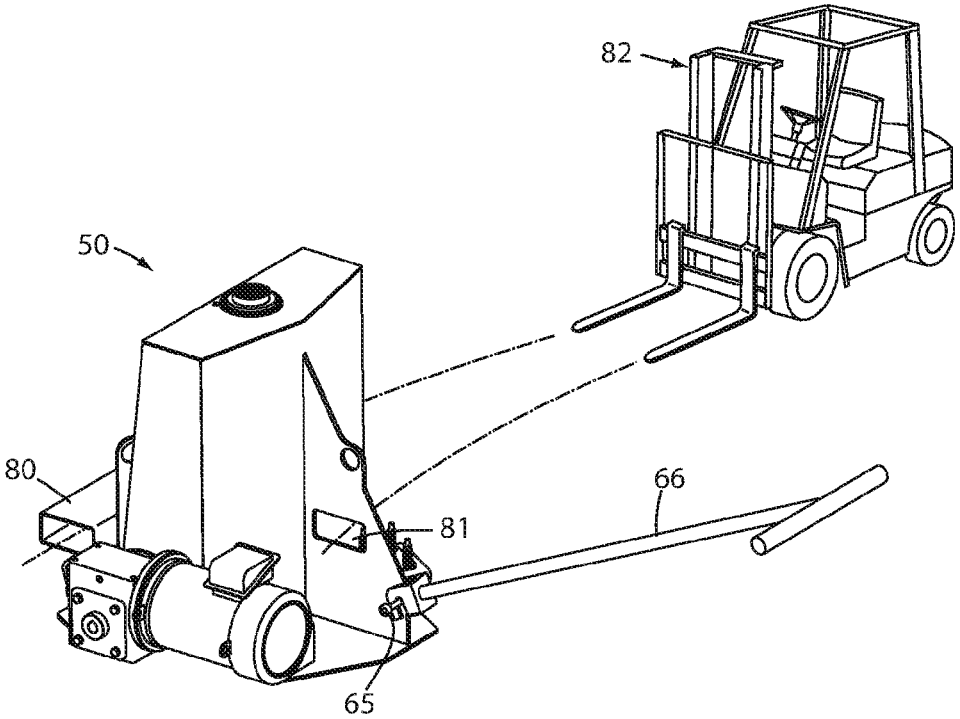
FIG. 15 is a perspective view showing a jack being moved using a pull handle and/or optionally fork truck.

Handle rods 65 (FIG. 15) are optionally positioned around the base plate 60 and attached to the braces 62 for grasping or pulling the apparatus 50. Also, the jack apparatus 50 can be moved in different ways, such as by using a handle 66 that engages one of the handle rods 65 (or engages one of the holes in the braces 62). The illustrated jack apparatus 50 includes a rectangular tube 80 positioned horizontally in notches in a rear of the rear two braces 65 and welded in place, and includes a rectangular opening 81 is formed into the front brace 62 at a height equal to the tube 80. The tube 80 and opening 81 are shaped to receive tines of a fork truck 82 (FIG. 15), making it possible to lift and move the present jacks using the fork truck 82. However, it is contemplated that some applications will not require a tube 80 nor openings 81.

Figure 13:
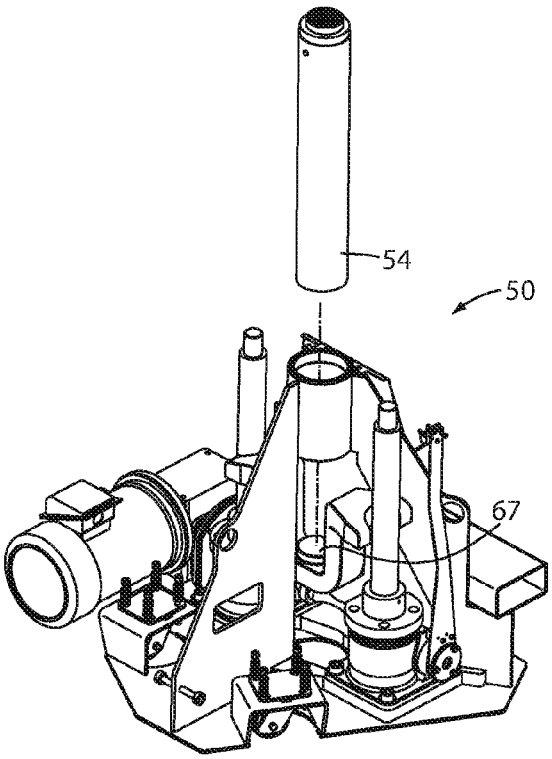
FIGS. 13-14 are partial perspective views showing removal of a lifting tube in the apparatus of FIG. 1.
Figure 14:
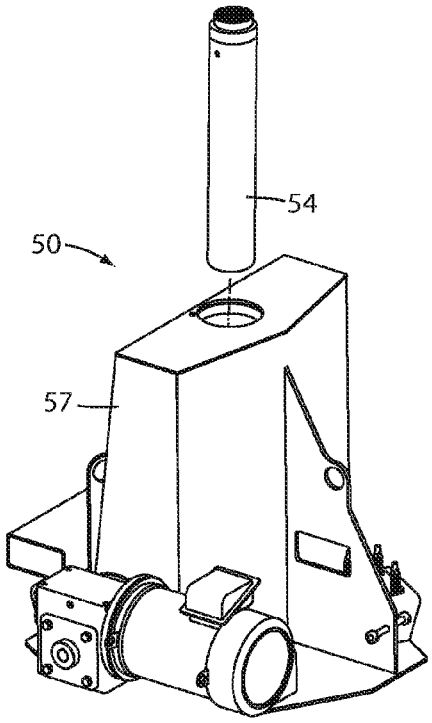

The angled braces 62 (FIGS. 3, 13-14) define between them an open center region through which the yoke 53 extends, providing sufficient room for the yoke 53 to move vertically through its lifting stroke. It is noted that the present yoke 53 is U-shaped, with raised ends resting on and carried by the screw jacks 52 and with a lowered center (e.g. 6-7 inches below the raised ends). The yoke 53 has several advantages. It allows two lower-capacity jacks to be used together to lift a (single) heavy load. It lets the apparatus use screw jacks having a longer stroke, yet simultaneously lets them be used at a lower initial lift point than they otherwise could be used. It also provides a very stable lift arrangement. Due to the offset nature of the arrangement, the "back" side of the jack apparatus, at a narrowest part of the housing 57, extends only 3.15 inches (i.e. 80 mm) from a center of the lifting tube 54. This allows the jack to be positioned under equipment lift points that are laterally very close to an obstruction (such as a wheel or track component).

Screw jacks are generally well known in the art. Thus a detailed description of the present screw jacks 52, their structure and function, is not required for an understanding of persons skilled in this art. It is sufficient to say that the screw jacks 52 have a threaded rotatable lifting shaft, a bottom support, a rotatable drive shaft on the bottom support that when rotated causes the lifting shaft to rotate to lift a load. The shaft coupler 55 connects the drive mechanisms of the illustrated screw jacks 52. The illustrated shaft coupler 55 includes enlarged ends for connection to the drive mechanism and a smaller middle portion so that the lifting tube clears the shaft's center. A shape of the yoke 53 allows it to drop to a lower initial lift position than otherwise possible.

As noted above, the yoke 53 has ends engaging the screw jacks 52 for lifting by the screw jacks 52, and has a lowered center portion that carries the lifting tube 54. The illustrated center portion has a nub or stud 67 that engages a recess in the lower end of the lifting tube 54, thus stably holding the tube 54 when placed thereon. This arrangement is very stable, yet allows for quick and easy replacement with another lifting tube 54 that is longer (or shorter). By providing several lifting tubes 54 of different lengths, the same jack apparatus 50 can be used and quickly adjusted to have a desired (low) starting and (high) ending lift point. For example, the present jack apparatus 50 can be lowered to have a collapsed height under 30 inches, which is exceptionally low compared to most jacks with an 18 inch stroke, and which is notably much lower than the screw jacks 52 will even allow based on their inherent length. It is noted that screw jacks can be made to have a low initial starting position, but in doing so, the screw jack must be made shorter, which limits its total lifting stroke.

The power unit 56 drives the shaft coupler 55 and drive mechanisms of the screw jacks 52. The illustrated power unit is an electric drive tailored in size to the particular jack on which it is used. However, it is contemplated that the power unit 56 can be a hydraulic drive unit or a pneumatic drive unit or other drive mechanism. In the illustrated jack apparatus 50, the power is preferably a 5 hp power unit. For example, if pneumatic, it could operate at 170 scfm at 100 psi (or higher). If hydraulic, it will operate at an oil pressure sufficient to drive the system at specified speeds and power of a desired jacking operation. The illustrated dual screw jacks provide a 50,000 lb (22,000 kg) lifting capacity. It is contemplated that different power units could be provided, and that they can be made replaceable and essentially interchangeable. It is noted that different countries have widely different electric and hydraulic requirements and capabilities, and further, many times certain energy sources are not available in remote areas where equipment must be worked on. The present arrangement uses a 5 hp power unit and has a very low initial clearance height (as noted below) and an 18 inch lifting stroke, which is considered to be a surprising and unexpected result that is not possible in existing known jack systems.

Figure 16:
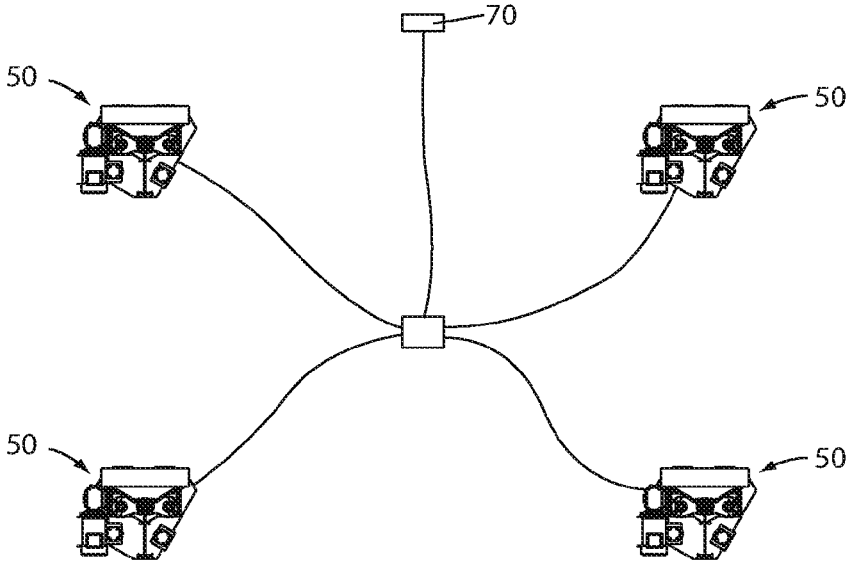
FIG. 16 is a schematic view showing four jacks being used in a jacking system for simultaneous lifting at multiple points on a vehicle.

The present jack apparatus 50 can be used independently by itself, or can be used as part of a system controlled by a single main controller 70 (FIG. 16). For example, the main controller 70 would communicate with individual controls on the drive units 56 to control two or four jack apparatus 50. The main controller may be operably connected to each of the "satellite" jack apparatus 50 by a physical control line, or could be operably connected by wireless communication technology. For example, if a pneumatic system is used, there will be air lines extending from the controller 70 to each of the multiple jack apparatus 50. By way of example, a single jack apparatus 50 might be used to change a wheel. Two jack apparatus 50 might be used to lift an axle, or to lift a side of a vehicle. Four jack apparatus 50 might be used to lift a loader or truck evenly (one jack apparatus at each wheel).

The present jack apparatus 50 has many desirable characteristics usually not found in existing jack systems, such as its modularity (so that components can be replaced easily in the field), ability to use different power sources to operate the jacks (e.g. electricity, or hydraulic, or pneumatic power), portability (i.e. durable enough for heavy-duty use but sufficiently light and portable for movement over rough terrain), safety against unexpected lowering of the jack even when a jack stand is not used (i.e. so that there is less risk of a worker bypassing safety procedures), close-to-obstruction lifting where the obstruction is only inches for a desired lift point. Also, a jack system is desired that can be used in a system where several jacks are controlled simultaneously for simultaneous lifting of equipment at multiple points on the equipment.

Figure 11:
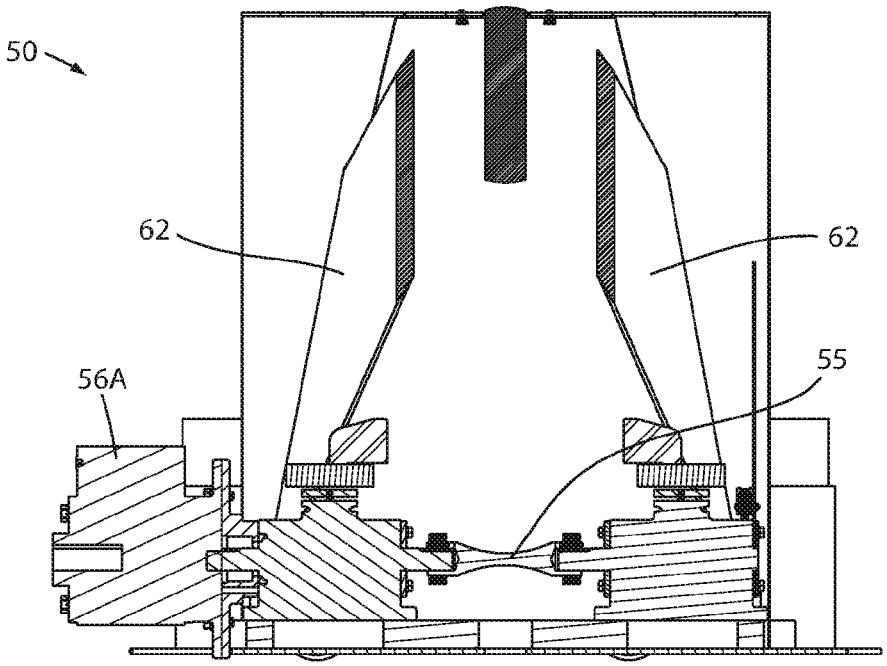
Figure 11A:
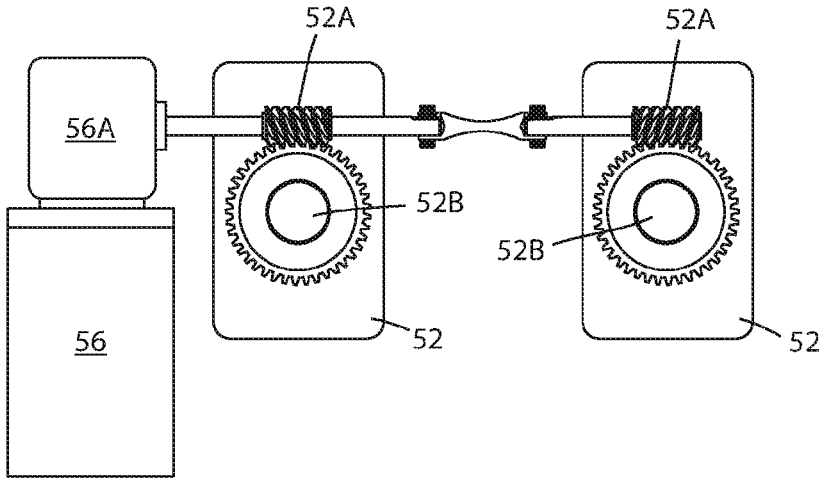
Figure 12:
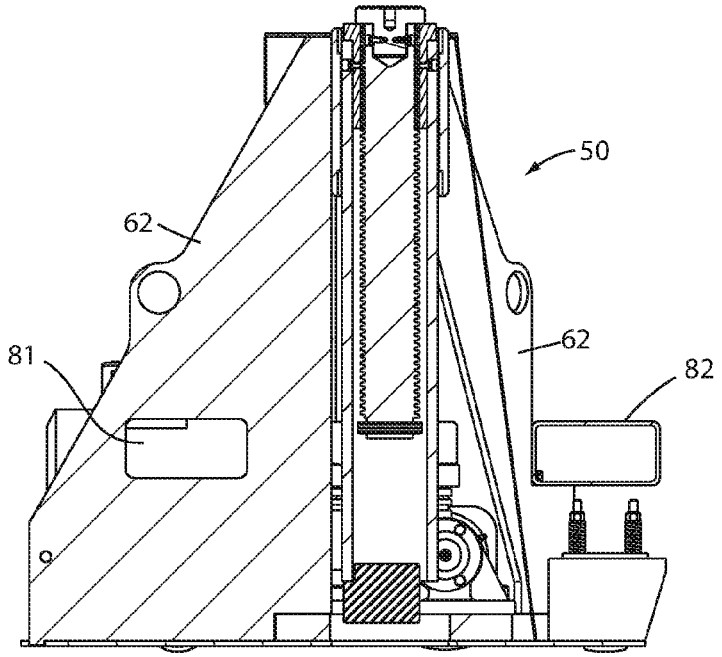

As noted above, the lifting tube 54 is supported on the yoke 53 and extends upwardly slidably through the tube section. Notably, a bottom end of the lifting tube 54 fits onto a stud on a center portion of the yoke 53 (FIG. 11). The lifting tube 54 is easily replaceable by lifting it away, and by substituting a longer (or shorter) lifting tube. By this configuration, the jack apparatus can be adjusted to a known/desired starting and ending lift point. A shortest lifting tube in the illustrated jack apparatus 50 provides a ground to top distance of 30 inches (760 mm) when in a lowest starting position, and provides a maximum stroke of 18 inches (460 mm). The stroke gained from using the present saddle-type yoke 53 is 6.8 inches. In other words, if the yoke 53 was not present, the required height for an 18 inch stroke of the screw jack would be 36.8 inches. It is contemplated that multiple length lifting tubes will be available, including lifting tubes that are 26.6 inches (which provides a starting height of 30 inches and a maximum height of 48 inches), 44.6 inches (which provides a starting height of 48 inches and a maximum height of 66 inches), and 62.6 inches (which provides a starting height of 66 inches and a maximum height of 84 inches). An advantage of the interchangeable tubes is that it allows the user to make the most of the available stroke. For example, instead of having to drive the jack up 5 inches to touch the lifting point (leaving only 13 inches of available stroke), the user can use the adjustable screw and replaceable tube to touch the desired lift point, and have basically all 18 inches of stroke available for lifting.

A unique feature has been discovered for a jack system with multiple electrically-operated jacks for heavy duty lifting. Referring to FIG. 16, the jack system includes a control system 70 operably connected (i.e. connected via hard wires or wireless system) to the electric drive unit of each jack for operating each of the jacks individually or simultaneously. The control system 70 includes (or communicates with) circuit breakers (not specifically illustrated, but well known in the electrical art) associated with each of the jacks. The control system 70 can be programmed to shut down all of the jacks 50 "downstream of" (i.e. interconnected or co- dependent on) the jack having the problem. For example, if the circuit breaker of one of the jacks indicates a problem . . . such as if one of the jacks 50 stops, overheats, and opens the associated circuit breaker . . . the control will shut down or stop other jacks, so that the problem is not compounded by unbalanced jacking. This can be communicated to the jack operator by various means, such as by an illuminated button or alarm on the control panel (not specifically illustrated), or indicated by the light to the problematic jack going off due to the circuit breaker stopping current flow to that jack. Due to the nature of the present power drive unit 56 and friction inherent within the threaded/geared drive mechanism (FIG. 11A), the jack will not lower even if electrical power is stopped or shut off.

Further, individual jacks 50 do not tend to get out of sequence (as may be a problem with hydraulic or pneumatic drives.

Methods of assembly and of use are also believed to be within a scope of the present inventive concepts. Persons skilled in the art will understand these methods without a separate detailed discussion.

It is to be understood that variations and modifications can be made on the aforementioned structure without departing from the concepts of the present invention, and further it is to be understood that such concepts are intended to be covered by the following claims unless these claims by their language expressly state otherwise.

The embodiments of the invention in which an exclusive property or privilege is claimed are defined as follows:

1. A jack apparatus for heavy duty lifting comprising:
a base;
a pair of screw jacks on the base;
a yoke supported for lifting by the screw jacks;
a lifting tube supported on the yoke;
a shaft coupler for simultaneously operating the screw jacks;
a power unit driving the shaft coupler;
a housing covering the screw jacks and the yoke, the housing defining a top that extends laterally less than 3.5 inches from a center of the lifting tube; and
wherein the pair of screw jacks slidably extend the lifting tube through the top of the housing.

2. The jack apparatus of claim 1, including a housing covering at least the yoke and the shaft coupler and a lower portion of the screw jacks.

3. The jack apparatus of claim 1, wherein the lifting tube is removable, and including a plurality of tubes of different lengths that can replace the lifting tube.

4. The jack apparatus of claim 1, including angled braces supporting a vertical orientation of the lifting tube.

5. A jack system comprising: a plurality of the jack apparatus defined in claim 1 and including a control operably connected to each of the plurality of jack apparatus for controlling simultaneous operation of the plurality of jack apparatus.

6. A jack apparatus for heavy duty lifting comprising:
a pair of screw jacks;
a yoke having ends supported by the screw jacks and a lower center section;
a lifting tube supported on the center section of the yoke; and
a power unit for simultaneously driving the screw jacks to lift the yoke and lifting tube.

7. The jack apparatus defined in claim 6, wherein each of the screw jacks includes a rotatable driving member for rotating a threaded lifting shaft of each screw jack, the shaft coupler connecting the rotatable driving members of each of the screw jacks.

8. A jack system comprising: a plurality of the jack apparatus defined in claim 6 and including a control operably connected to each of the plurality of jack apparatus for controlling simultaneous operation of the plurality of jack apparatus.

9. A jack apparatus for heavy duty lifting comprising:
a base including a base plate, a cylindrical tube section, and angled braces supporting the tube section on the base plate;
at least one screw jack on the base;
a yoke supported for lifting by the at least one screw jack; and
a plurality of lifting tubes having different lengths and adapted to be supported on the yoke with an upper end extending upwardly slidably through the tube section, each of the lifting tubes being releasably supported on the yoke for replacement so that the jack apparatus has different lowest and highest lift points.

10. A jacking system comprising:
at least two jack apparatus for simultaneous operation for heavy duty lifting; each jack apparatus including a pair of screw jacks with a threaded lifting shaft and a rotatable driving member for vertically extending the threaded lifting shaft, a yoke having ends supported by the lifting shafts of the screw jacks and a lower center section, a lifting tube supported on the center section of the yoke, and a power unit for simultaneously driving the screw jacks to lift the yoke and lifting tube; and
a control unit operably connected to each of the power units of each jack apparatus to simultaneously operate each of the jack assemblies an equivalent amount.

11. The jack apparatus of claim 10, wherein the power unit includes an electric motor operably connected to driving nuts on the screw jacks, and wherein the driving nuts and electric motor prevent accidental lowering of the screw jacks if electrical power is lost.

12. A jack system for heavy duty lifting, comprising:
a plurality of jacks, each including:
a base with at least one screw jack on the base;
a lifting tube supported by the at least one screw jack;
a housing covering the lifting tube, wherein the at least one screw jack slidably extends the lifting tube through a tubular top of the housing, the lifting tube being releasably supported for replacement;
a shaft coupler for operating the at least one screw jack;
an electric drive unit coupled to and configured to drive the shaft coupler; and
a control system operably connected to the electric drive unit of each jack for operating each of the jacks individually or simultaneously, the control system including circuit breakers associated with each of the jacks, the control system being configured to shut down selected ones of jacks if the circuit breaker of a particular one of the jacks indicates a problem.

13. The jack system of claim 12, wherein the at least one screw jack includes a pair of screw jacks and a yoke extending between the screw jacks, and wherein the lifting tube is supported on the yoke.

14. A method for heavy duty lifting, comprising:
providing a plurality of jacks, each including:
a base with at least one screw jack on the base;
a housing covering the at least one screw lack;
a lifting tube supported by the at least one screw jack; the lifting tube having an upper end extending upwardly slidably through a top of a tube section of the housing and being releasably supported for replacement;
a shaft coupler for operating the at least one screw jack; and
an electric drive unit coupled to and configured to drive the shaft coupler;
providing a control system operably connected to the electric drive unit of each jack for operating each of the jacks individually or simultaneously, the control system including circuit breakers associated with each of the jacks;
operating the screw lack to extend the lifting tube slidably through the top of the housing; and shutting down all of the jacks if the circuit breaker of one of the jacks indicates a problem.

15. A jack system for heavy duty lifting, comprising:

a plurality of jacks, each including:

a base with at least one screw jack on the base;

a housing including a top;

a lifting tube supported by the at least one screw jack and wherein the at least one screw jack slidably extends the lifting tube through the top of the housing;

a shaft coupler for operating the at least one screw jack;

an electric drive unit coupled to and configured to drive the shaft coupler; and a control system operably connected to the electric drive unit of each jack for operating each of the jacks individually or simultaneously.

16. A jack system for heavy duty lifting, comprising:

a plurality of jacks, each including:

a base with at least two screw jacks on the base;

a yoke having ends supported by the two screw jacks and having a lower center section;

a lifting tube supported by the lower center section;

a shaft coupler for operating the at least one screw jack; and an electric drive unit coupled to and configured to drive the shaft coupler; and a control system operably connected to the electric drive unit of each jack for operating each of the jacks individually or simultaneously.

* * * * *